United States Patent [19]

Fukuzawa et al.

[11] Patent Number: 4,792,810

[45] Date of Patent: Dec. 20, 1988

[54] MICROWAVE ANTENNA

[75] Inventors: Keiji Fukuzawa, Chiba; Fumihiro Ito, Tokyo; Shinobu Tsurumaru, Kanagawa, all of Japan

[73] Assignee: Sony Corporation, Tokyo, Japan

[21] Appl. No.: 888,117

[22] Filed: Jul. 22, 1986

[30] Foreign Application Priority Data

| | | | |
|---|---|---|---|
| Jul. 23, 1985 | [JP] | Japan | 60-162650 |
| Mar. 20, 1986 | [JP] | Japan | 61-63176 |
| Mar. 20, 1986 | [JP] | Japan | 61-63177 |
| Mar. 20, 1986 | [JP] | Japan | 61-63178 |

[51] Int. Cl.[4] ..... H01Q 1/38; H01Q 13/08

[52] U.S. Cl. ..... 343/778; 343/700 MS

[58] Field of Search ..... 343/700 MS, 769, 777, 343/778, 799, 762; 333/120, 121, 122, 123

[56] References Cited

U.S. PATENT DOCUMENTS

| | | | |
|---|---|---|---|
| 4,208,660 | 6/1980 | McOwen, Jr. | 343/769 |
| 4,527,165 | 7/1985 | de Ronde | 343/778 |
| 4,543,579 | 9/1985 | Teshirogi | 343/700 ms |
| 4,614,947 | 9/1986 | Rammos | 343/778 |
| 4,626,865 | 12/1986 | Rammos | 343/786 |
| 4,644,362 | 2/1987 | Rammos | 343/786 |

*Primary Examiner*—William L. Sikes
*Assistant Examiner*—Doris Johnson
*Attorney, Agent, or Firm*—Hill, Van Santen, Steadman & Simpson

[57] ABSTRACT

A planar antenna for circular polarized microwaves incorporates a substrate sandwiched between conductive layers having a plurality of openings arranged in a rectangular array, with a pair of perpendicular excitation probes supported on the substrate in alignment with each opening, and a feed circuit for interconnecting the excitation probes in a predetermined phase relationship. Two additional conductive elements may be supported on the substrate in alignment with the excitation probes to provide improved impedance matching. The feed circuit may incorporate a pair of quarter wavelength feed lines connected to the excitation probes, with a resistance element interconnected between the feed lines. The feed point of the antenna may be located near the center of the array, occupying a position normally occupied by one of the pairs of excitation probes.

24 Claims, 9 Drawing Sheets

MICROWAVE ANTENNA

BACKGROUND

The present invention relates to microwave antennas, and particularly to planar antennas for circularly polarized waves.

A number of designs have been proposed for high frequency planar antennas, particularly with respect to antennas intended to receive satellite transmissions on the 12 GHz band. One previous proposal is for a microstrip line feed array antenna, which has the advantage that it can be formed by etching of a substrate. However, even when a low loss substrate such as teflon or the like is used, there are considerable dielectric losses and radiation losses from this type of antenna. Accordingly, it is not possible to realize high efficiency, and also when a substrate is used having a low loss characteristic the cost is relatively expensive.

Other proposed antenna designs are a radial line slot array antenna, and a waveguide slot array antenna. These antennas tend to have reduced dielectric and radiation losses, as compared to the microstrip line feed array antenna. However, the structure is relatively complicated, so that production of this antenna design becomes a difficult manufacturing problem. In addition, since each of these designs are formed as a resonant structure, it is very difficult to obtain gain over a wide passband, for example 300 to 500 MHz. Furthermore, these designs are complicated by the cost of coupling between slots, which makes it very difficult to obtain a good efficiency characteristic.

Another proposal is for a suspended line feed aperture array. This design has a structure which overcomes some of the foregoing defects, and can also provided a wide band characteristic, using an inexpensive substrate. Suspended feed line antennas are illustrated in European Patent Application Nos. 108463-A and 123350 and in MSN (Microwave System News), published March 1984, pp. 110–126.

The antenna disclosed in the first of the above applications incorporates copper foils which have to be formed perpendicularly relative to both surfaces of a dielectric sheet which serves as the substrate. Since the structure is formed over both surfaces of the substrate, the interconnection treatment becomes complicated, and the antenna is necessarily relatively large in size.

The antenna disclosed in the other above-cited application requires copper foils to be formed on two separate dielectric sheets. It is difficult to get accurate positioning of these foils, and the construction becomes relatively complicated and expensive. In the antenna disclosed in the MSN publication, one excitation probe is formed in each of a plurality of openings to form an antenna for a linear polarized wave. Such an antenna cannot effectively be used to receive a circular polarized wave, because the gain is poor, and two separate substrates must be used, making the construction relatively complicated and expensive.

BRIEF DESCRIPTION OF THE PRESENT INVENTION

A principal object of the present invention is to provide a circular polarized wave planar array antenna in which a pair of excitation probes are formed in a common plane on a single substrate, to transmit or receive a circular polarized wave, while attaining simplicity of construction, low-cost and excellent performance characteristics. In accordance with one embodiment of the present invention, a substrate is sandwiched between conductive layers having a plurality of openings, with a pair of perpendicular excitation probes being located in alignment with each opening, with signals from the excitation probes being combined in a predetermined phase relationship with each other.

In a development of the invention, two additional conductive elements are provided in alignment with the excitation probes to provide improved impedance matching relative to the openings in the conductive layers.

In a further development of the invention, a connection network is associated with each pair of excitation probes, comprising a pair of feed lines each having length of a quarter wavelength and a resistance element interconnected between such feed lines.

In another development of the present invention, the feed point of the antenna array is located near the center thereof, and occupies the position normally occupied by one of the pairs of excitation probes.

BRIEF DESCRIPTION OF THE DRAWINGS

Reference will now be made to the accompanying drawings in which.

BRIEF DESCRIPTION OF THE PREFERRED EMBODIMENTS

Figure 1:
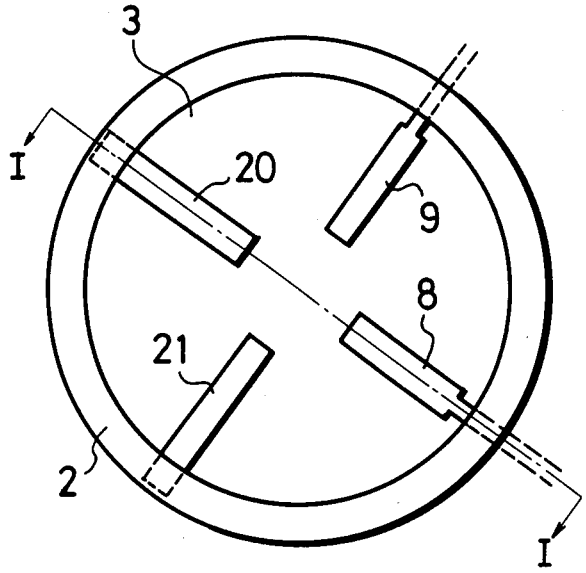
FIG. 1 is a top view of a circular polarized wave radiation element constructed in accordance with one embodiment of the present invention.
Figure 2:
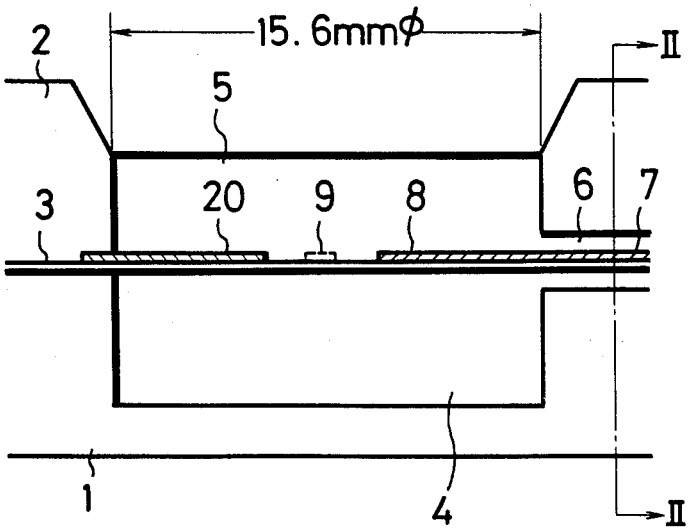
FIG. 2 is a cross-sectional view of the apparatus of FIG. 1 taken along the line I—I.

Referring to FIGS. 1 and 2, an insulating a substrate 3 is sandwiched between metal layers 1 and 2 (which may be formed of sheet metal such as aluminum or metalized plastic). A number of openings 4 and 5 are formed in the layers 1 and 2, the opening 4 being formed as a concave depression or recess, in the layer 1, and the opening 5 being formed as an aperture in the layer 2. FIG. 1 has a plan view of the structure.

A pair of excitation probes 8 and 9, oriented perpendicular to each other, are formed on the substrate 3 in a common plane, in alignment with the openings 4 and 5 as illustrated in FIG. 1. The excitation probes 8 and 9 are each connected with a suspended line conductor 7 located within a cavity 6 which forms a coaxial line for conducting energy between the excitation probes 8 and 9 and a remote point. The substrate 3 is in the form of a thin flexible film sandwiched between the first and second metal or metalized sheets 1 and 2. Preferably, the openings 4 and 5 are circular, and of the same diameter, and the upper opening 5 is formed with a conical shape is illustrated in FIG. 2.

Figure 3:
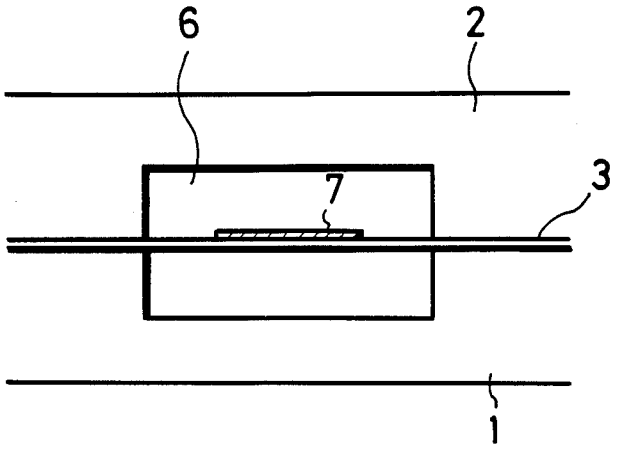
FIG. 3 is a cross-sectional view of one of the suspended line sections of the apparatus of FIGS. 1 and 2, taken along the line II—II in FIG. 2.

The suspended line conductor 7 comprises a conductive foil supported on the substrate 3 centrally in the cavity portion 6 to form a suspended coaxial feed line. A cross-section of this suspended line is illustrated in FIG. 3. The foil 7 forms the central conductor and the conductive surface of the sheets 1 and 2 form the outer coaxial conductor.

Figure 4:
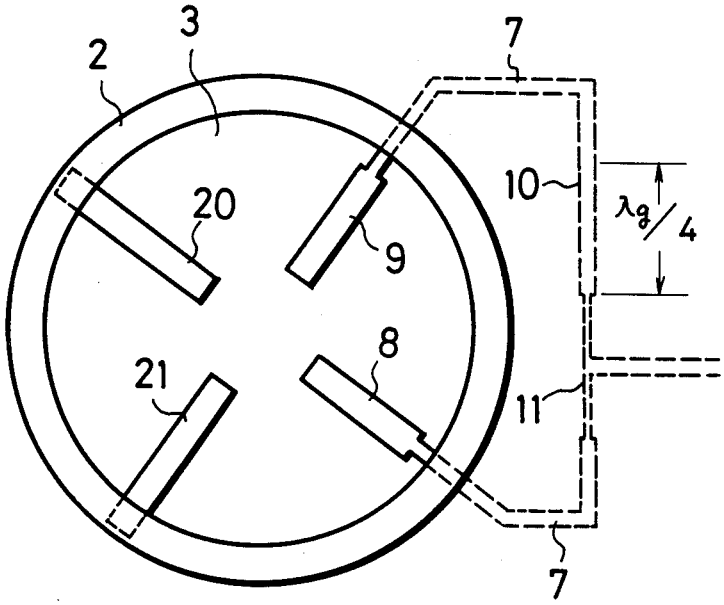
FIG. 4 is a top view of one of the radiation elements of the antenna of one embodiment of the present invention, showing the suspended lines for feeding the excitation probes.

FIG. 4 illustrates that the conductive foil 7 is formed into elongate feed lines, arranged perpendicular to each other, where they are connected to the excitation probes 8 and 9, and connected together by a common leg. The foils are connected to a feed line at the point 11, which is offset relative to the center of the common leg, as shown in FIG. 4, so that the excitation probe 9 is fed by a line having a longer length, indicated by reference numeral 10, of one quarter of wavelength, relative to the length of the feed in the excitation probe 8. The wavelength referred to here (and elsewhere in this application) is the wavelength of energy within the waveguide or suspended line 7, indicated by $\lambda/g$, which wavelength is determinable from the frequency of the energy and the geometry of the waveguide. With this arrangement, (considering the antenna as a transmitting antenna) a circular polarized wave results, as the result of linear polarized waves launched from excitation probes 8 and 9 which are out of phase by $\pi/2$, or one quarter wavelength.

Preferably, the foil 7 is formed as a printed circuit by etching a conductive surface on the substrate 3, so as to remove all portions of the surface except for the conductive portions desired to remain such as the foil 7, and the excitation probes 8 and 9, etc. Preferably, the conductive foil has a thickness of, for example 25 to 100 micrometers. Since the substrate 3 is thin and serves only as a support member for the foil 7, even though it is not made of low loss material, the transmission loss in the coaxial line is small. For example, the typical transmission loss of an open strip line using a teflon-glass substrate is 4 to 6 dB/m at 12 GHz, whereas the suspended line of the invention has a transmission loss of only 2.5 to 3 dB/m, using a substrate of 25 micrometer in thickness. Since the flexible substrate film 3 is inexpensive, compared with the teflon-glass substrate, the arrangement of the present invention is much more economical.

As illustrated in FIG. 4, the phase of the signal applied to the excitation probe 8 (as a transmitting antenna) is advanced by a quarter of the wavelength (relative to the center frequency of the transmission band) compared with that applied to the excitation probe 9. This arrangement, when used as a receiving antenna, allows a clockwise circular polarized wave to be received, since the excitation probe 8 comes into alignment with the rotating E and H vectors of the wave one quarter cycle after the excitation probe 9 is in such alignment. Because of the increased length 10 of the foil line connected with the excitation probe 9, the excitation probes 8 and 9 contribute nearly equal in-phase components to a composite signal at the T or combining point 11.

If the extra length 10 were inserted in the foil line 7 connected with the excitation probe 8, then the arrangement would receive a counter-clockwise circular polarized wave. It would be appreciated that this can be effectively accomplished merely by turning over the sheet 3 on which the excitation probes 8 and 9 and the feed lines 7 are supported, so that the structure of the present invention can receive both kinds of circular polarization, with slight modification during assembly.

Figure 5:
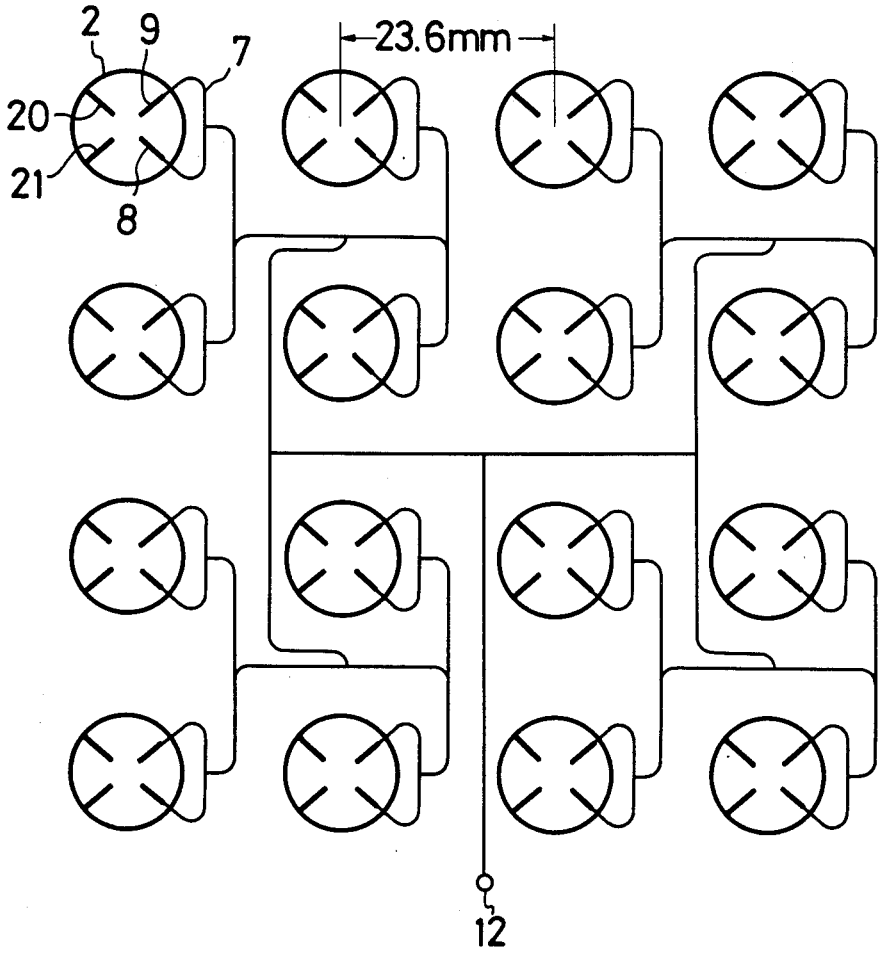
FIG. 5 is a plan view illustrating the interconnection of a plurality of radiation elements.

FIG. 5 illustrates a circuit arrangement in which a plurality of radiation elements, each like that illustrated in FIGS. 1–4, are interconnected by foil lines printed on the sheet 3. Each of the radiation elements contributes a signal in phase with the signal contributed by every other radiation element, which are interconnected together at a point 12. It will be appreciated from an examination of FIG. 4 that the length of the foil line 7 from the point 12 to any of the individual excitation probes 8 and 9, constitutes an equal distance, so that the signals received from each radiation element arrive at the point 12 in phase with the others. The array of FIG. 5 shows the printed surface on the substrate 3, and the aligned position of the openings 5 in the sheet 2. The substrate S is sandwiched between the conductive sheets 1 and 2 having the openings 4 and 5 (FIG. 2) aligned with each of the radiation elements, so that all of them function in the manner described above in connection with FIGS. 1–4. Using the general arrangement illustrated in FIG. 5, it is possible to obtain various radiation patterns, by changing characteristics of the lines For example, if the distance from the common feed point 12 to the excitation probes 8 and 9 of some of the radiation elements is changed, the phase of the power contributed by those radiation elements can be changed. Further, if the ratio of impedance is changed by reducing, or increasing, the thickness of the suspended lines at the places where it is branched (as shown in FIG. 5) it is possible to change the amplitude of the signals contributed from the branches to the common line of the branch. This affects the relative power and phase of the signals contributed from each of the receiving elements, with the result of changing the radiation pattern of the antenna.

Although the antenna is asymmetrical on the common plane, an isolation of more than 20 dB is established between probes at a frequency of 12 GHz, with a return loss being as low as 30 dB. The axial loss approximates about 1 dB in the vicinity of about 12 GHz.

Figure 7:
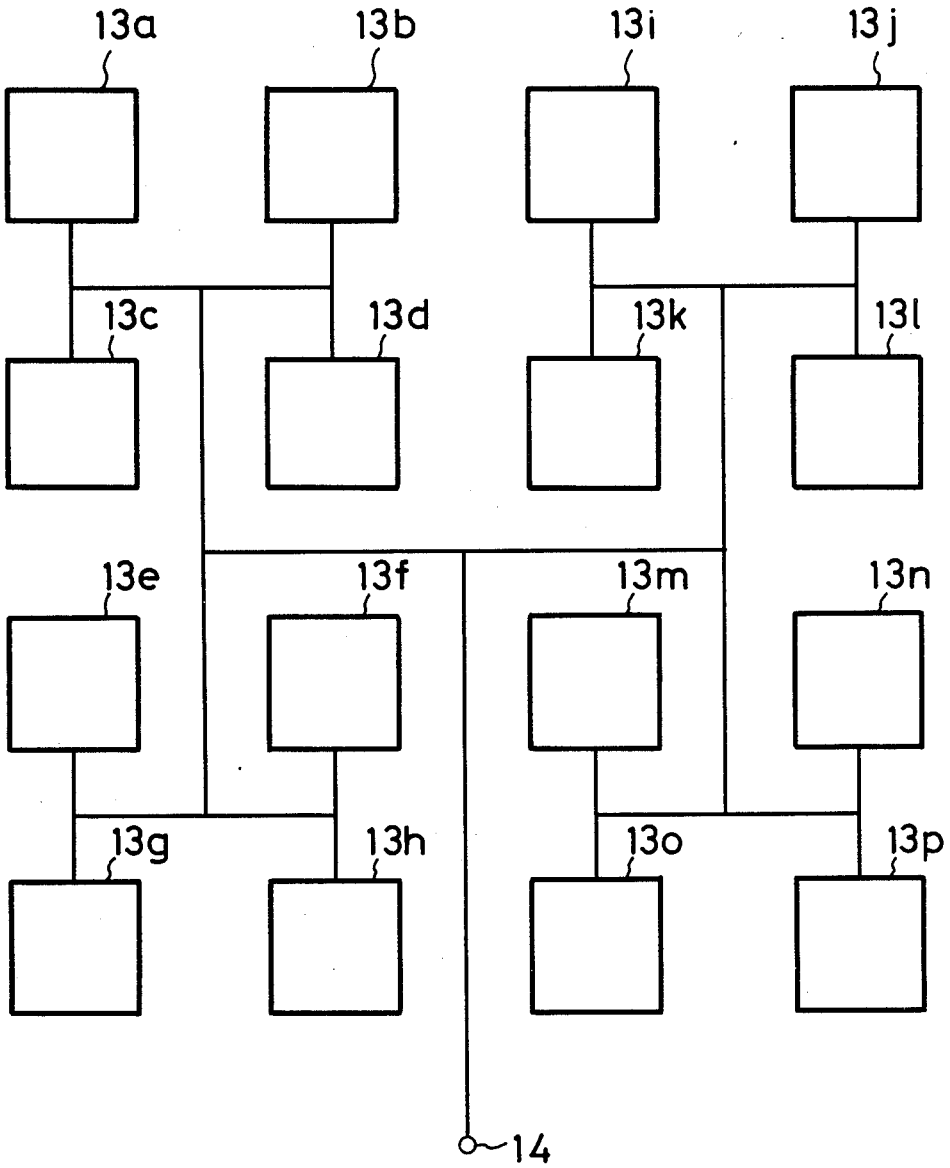
FIG. 7 is a functional block diagram illustrating the manner of connection of a plurality of sub-arrays.

FIG. 7 illustrates the construction of a large circular polarized array, using a plurality of the array subgroups illustrated in FIG. 5. Sixteen array groups 13*a*–13*p* are all interconnected at a common point 14, in such a fashion that the length of the interconnecting lines are all equal. In this case, the antenna is formed with 256 circular polarized wave radiation elements, arranged in an equi-spaced rectangular array, and each element is located at an equal distance from the feed point 14.

Figure 8:
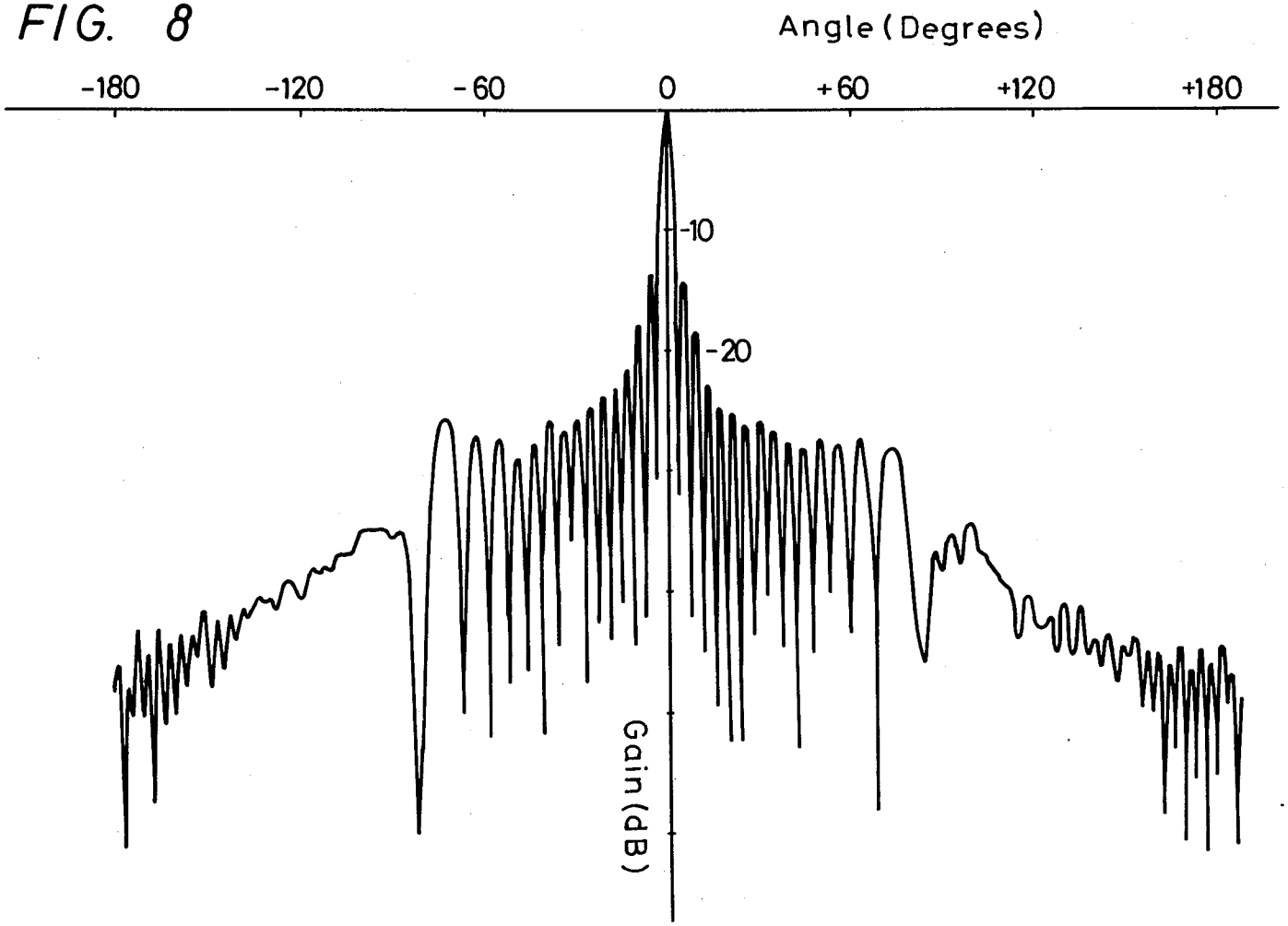
FIG. 8 is a graph indicating a radiation pattern of one embodiment of the present invention.

FIG. 8 shows a radiation pattern which is characteristic of the arrangement illustrated in FIG. 7. In this case, the distance between the radiation elements is selected to be 0.95 (at a frequency of 12 GHz), and the phase and amplitude are selected to be equal for all radiation elements. Since the mutual coupling between the radiation elements is small, the characteristic is highly directional, as shown.

Because of the construction of an antenna in accordance with the present invention, the antenna can be made very thin, and with a simple mechanical arrangement. Even when inexpensive substrates are used, the gain obtained from the antenna is equal to or greater than that of an antenna which uses the relatively expensive microstrip line substrate technology.

When the spacing of the radiation elements is selected in the range from 0.9 to 0.95 wavelength relative to a 12 GHz wave in free space (ranging from 22.5 to 23.6 mm), the width of the cavity portion for the suspended line is selected as 1.75 mm, and the diameter of the openings 4 and 5 in sheets 1 and 2 is selected as 16.35 mm. However, for most effective reception of the satellite broadcasting frequency band (11.7 to 12.7 GHz) it is desirable to select the line width to be wider than 2 mm, and a reduced diameter of the radiation element. For example, for most effective reception, the diameter it must be reduced from 16.35 to about 15.6 mm.

Figure 6:
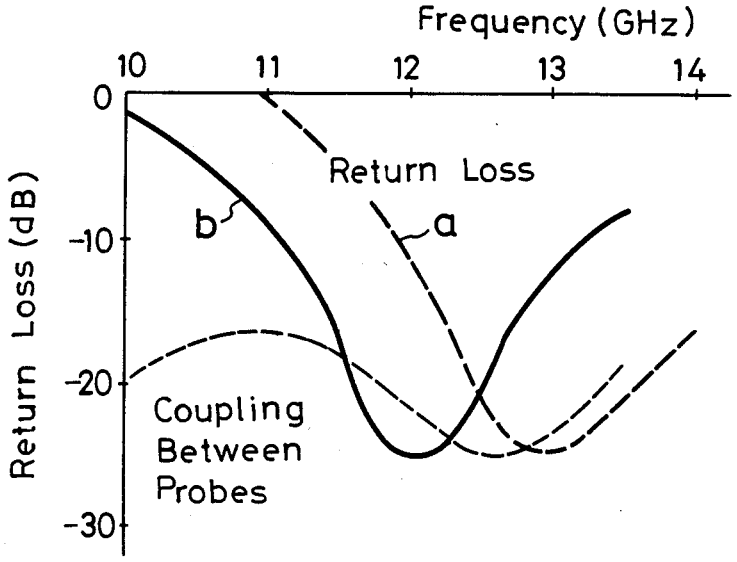
FIG. 6 are frequency characteristics of embodiments of the present invention.

However, if the diameter of the radiation element is selected as small as 15.6 mm, the cut-off frequency of the dominant mode ($TE_{11}$ mode) of the circular waveguide having this diameter becomes about 11.263 GHz. As the result, it becomes difficult to achieve impedance matching between the cavity portion formed by the openings 4 and 5 and the excitation probes, and the antenna becomes relatively narrow in band width. Thus, the characteristic of the return losses change. This is shown by the broken line a in FIG. 6, with the result that the return loss near the operation frequency (11.7 to 12.7 GHz) and deteriorates. The "return loss" refers to the loss resulting from reflection due to unmatched impedances. With this application therefore, better impedance matching is necessary. This matching is provided in the arrangement of FIGS. 1–5 by the use of conductive segments 20 and 21 which are aligned with excitation probes 8 and 9 within each radiation element. These elements, as shown in FIGS. 1 and 2, are aligned end to end and in line with the excitation probes 8 and 9 and spaced apart therefrom, as shown in FIGS. 1 and 4. The conductive segments 20 and 21 are elongate, rectangular and are formed as printed circuits or otherwise deposited on the surface of the substrate 3. They extend beyond the perimeter of the opening 5 to be in electrical contact with the layer 2. The use of the segments 20 and 21 makes it possible to lower the cut-off frequency of the radiation element, and to improve the return loss to that shown in the solid line b of FIG. 6. When the optional conductive segments 20 and 21 are not used, the probes 8 and 9 are in the same positions, relative to the openings 4 and 5. In that case, the return loss characteristic is about −30 dB at minimum, with a narrower pass band characteristic, i.e. a steeper fall off from the minimum. The isolation between the coupling probes 8 and 9 is greater than 20 dB, as shown in FIG. 6, so the radiation element effectively receives circular polarized radiation in the same manner as described above. When the radiation elements are spaced apart by 23.6 mm, as illustrated in FIG. 5, then an array of 256 radiation elements, arranged in the manner of FIG. 7, forms a square of 40 cm by 40 cm.

It will be appreciated, that because of the reciprocity principle of an antenna, the radiation elements of the antenna of the present invention function equally effectively as transmitting radiation elements, and receiving radiation elements. Thus, the antenna array of the present invention can function effectively as a transmitting or receiving antenna array.

Because of the conductive segments 20 and 21, the cutoff frequency is lowered, so that the matching can be established to improve the return loss from the dashed line a of FIG. 6 to the solid line b of FIG. 6. When the diameter of the openings 4 and 5 of the radiation element is selected as 15.6 mm, then a waveguide having a small diameter can be used, and the image suppression is improved.

It is possible to improve the standing wave ratio (VSWR) at the T section 11 where the two foils 7 from the excitation elements are interconnected to a common feed line. With the T branching arrangement, a portion of a wave received from one of the excitation probes passes through the T toward the other excitation probe, with the result that the axial ratio of the circular polarized is deteriorated. The ratio is a ratio (for an elliptically polarized wave) between the diameters of the major and minor axes of the elipse representing the polarization. For a circular polarized wave, the axial ratio is 1.

In the arrangement of FIG. 4, when the two signals to be combined are not equal in amplitude and phase, then signals in the two legs are not balanced, and a combining loss is generated. A combining loss is also generated when the impedance connected between the combining terminals is not matched, which degrades the axial ratio of the circular polarized wave.

Figure 9:
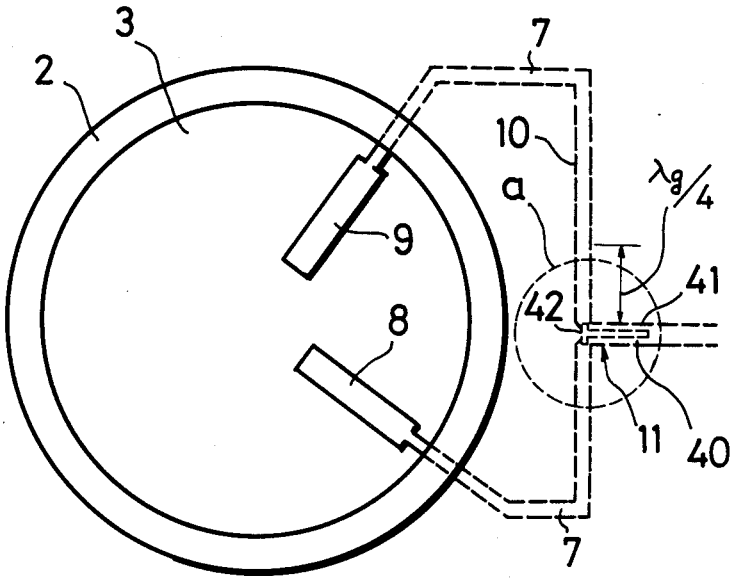
FIG. 9 is a top view of a modified form of the radiation element, illustrating a network for feeding the excitation probes.
Figure 10:
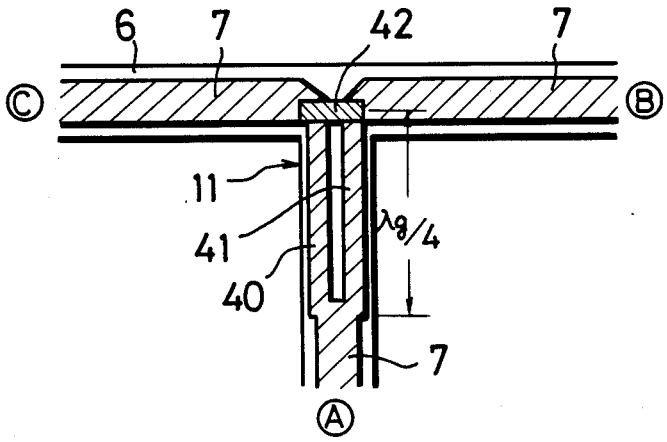
FIG. 10 is a plan view of a portion of the apparatus of FIG. 9.

FIG. 9 illustrates a radiation element with an improved T combiner, surrounded by the dashed line a. An enlarged view of the area within the dashed line a is illustrated in FIG. 10. The common feed line 7 is indicated in FIG. 10 as a leg A, with legs B and C leading to the excitation probes 8 and 9. A printed resistor 42 is placed on the substrate interconnecting the legs B and C. Between the printed resistor 42 and the common leg A, the foil line 7 is separated into a pair of one quarter wavelength lines 40 and 41, which interconnect the common leg A with the legs C and B, respectively. The resistor 42 is formed, for example, by carbon printing on the substrate. This circuit forms what may be called Wilkinson-type power combiner or a 3 dB. $\pi/2$ hybrid ring-type combiner. In a case where the impedances of all three legs A, B and C are matched with each other, and power is supplied from a leg C, then one quarter of the power is passed through the printed resistor 42, and three quarters of the power is passed through to the line 40. Of the power passed to the line 40, two thirds of this is supplied to the 1eg A, with the remainder (namely, one fourth of the original supplied power) being passed through the line 41. Since the two components passed through the resistor 42 and through the line 41 are equal and opposite in phase, they substantially cancel each other out, with the result that there is no power which reaches the leg B from the leg C. Accordingly, the isolation between the legs B and C becomes about −25 dB, with an improvement in the axial ratio.

Figure 11:
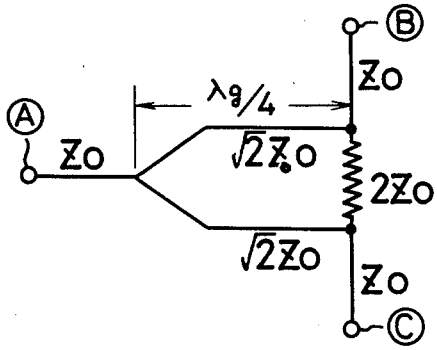
FIG. 11 is an equivalent circuit diagram of the apparatus of illustrated in FIGS. 9 and 10.

The equivalent circuit of the combiner of FIGS. 9 and 10 is shown in FIG. 11. This equivalent circuit is based on the theory of a Wilkinson-type power divider, as described in "An N-Way Hybrid Power Divider", IEEE Trans. Microwave Theory in Tech., MTT-8, 1, p. 116 (Jan. 1960), by E. J. Wilkinson. Here, $Z_0$ represents the characteristic impedance of the feed line, and the characteristic impedance of $Z_0$ at the legs B and C is matched to the impedance of the radiation element. When the impedance at all three legs are matched, the input from the leg A is divided with a certain ratio, and appears at the input and output terminals B and C. In the case of an input from the terminal B, a part of this input appears at the terminal A, with remaining part being absorbed by the resistor 2 $Z_0$, so that the corresponding power is not generated at the terminal C. The y-type power combiner can achieve the isolation between the terminals while allowing the power received at the terminals B and C to be combined at the terminal A.

Figure 12:
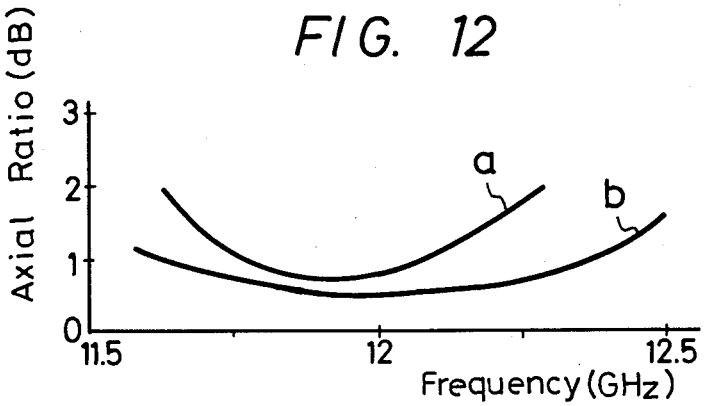
FIG. 12 is a frequency characteristic of the radiation element of embodiments of the invention.

FIG. 12 shows the characteristic of the circular polarized wave radiation element, in which the solid line indicates an example of measured results of the axial ratio of an antenna without the combiner or FIGS. 9 and 10, while the solid line B indicates the measured results of the axial ratio when a straight T combiner is used. For example, at a frequency of about 12 GHz, an axial ratio of about 1 dB is tolerable, meaning that, when used as a transmitting antenna, the transmitted power at times spaced by $\pi/2$ does not vary by more than 1 dB. As shown in line b of FIG. 12, this figure is realized over a broad frequency band. Line a shows the characteristic when the combiner of FIGS. 9–10 is not used.

With the closely packed radiation elements illustrated in FIGS. 5 and 7, it is difficult to provide a feed point at the center of the array, so the feed point must be brought out to the outer edge of the array as shown. This results in a relatively longer feed path, with attenuation of the signal. It is desirable to couple the array to a standard rectangular waveguide such as type WR-75 or WRJ-120.

Figure 13:
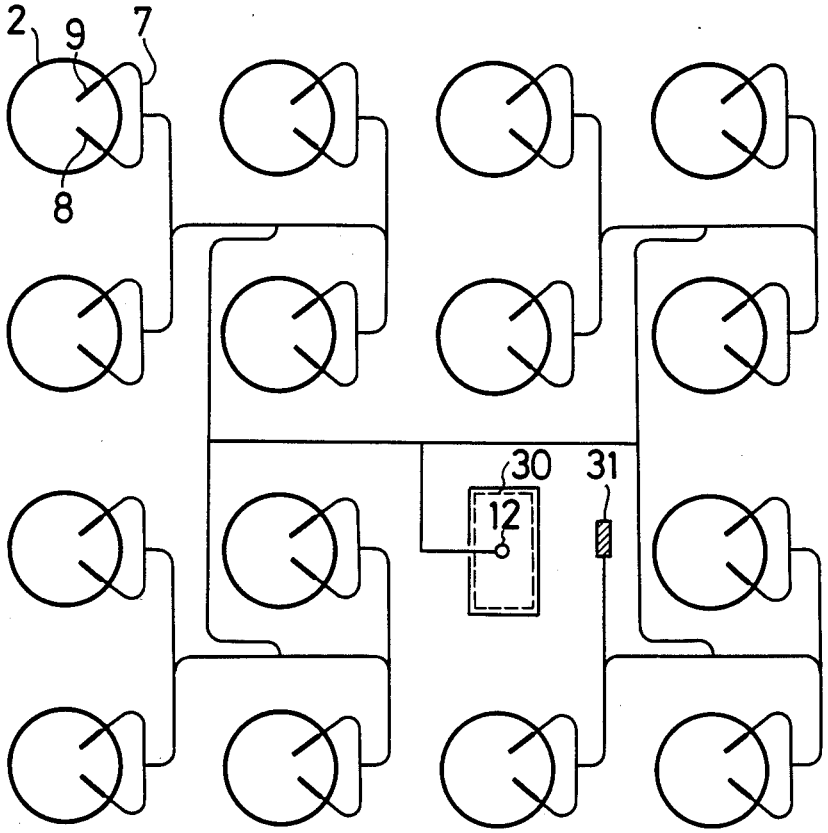
FIGS. 13 and 14 are plan views of two modified interconnection diagrams for central feeding of a plurality of radiation elements.

Referring to FIG. 13, an array is illustrated in which a central feed is supplied to a plurality of circular polarized wave radiation elements, all in phase, from a feed point 12. All of the radiation elements are located at the same distance from the feed point 12 by means of the foil 7 connecting the central point 12 to the probes 8 and 9 of each radiation element 2. In the arrangement of FIG. 13, one the radiation elements closest the center of the array is removed, and a rectangular waveguide, the outline which is shown in rectangular dashed box 30, is attached to the array at this point. The transition from a rectangular waveguide to the coaxial line (shown in cross-section in FIG. 3) is made in the conventional way and therefore need not be described in detail. A resistor 31 is provided to terminate the line normally connected to the removed radiation element with the characteristic impedance of the feed line, to avoid any reflection effect from the removal of this radiation element. By using the arrangement of FIG. 13, the length of the feed line becomes shorter than that shown in FIG. 5. For a larger array, such as that of FIG. 7, each of the sub-arrays of array FIG. 7 is made up of an array like that of FIG. 5, for example. One of the four sub-arrays closest to the center of the array has one radiation element (at its corner nearest the center) omitted, and that radiation element is replaced by a feed connection leading to the branch at the array center, and a terminating resistor 31.

The conversion loss of such an array is relatively low, and the array can be connected to a normal rectangular waveguide. This advantage increases in importance when the array structure has more radiation elements. The fact that the radiation pattern is disordered to a minor extent by the removal of one radiation elementddoes not represent a serious effect in practice. Particularly when there is a large number of radiation elements, excited in equal phase and equal amplitude, the effect of the removal of one radiation element is small. Furthermore, the central feeding arrangement allows a more convenient structure in which the waveguide 30 is centrally located.

Figure 14:
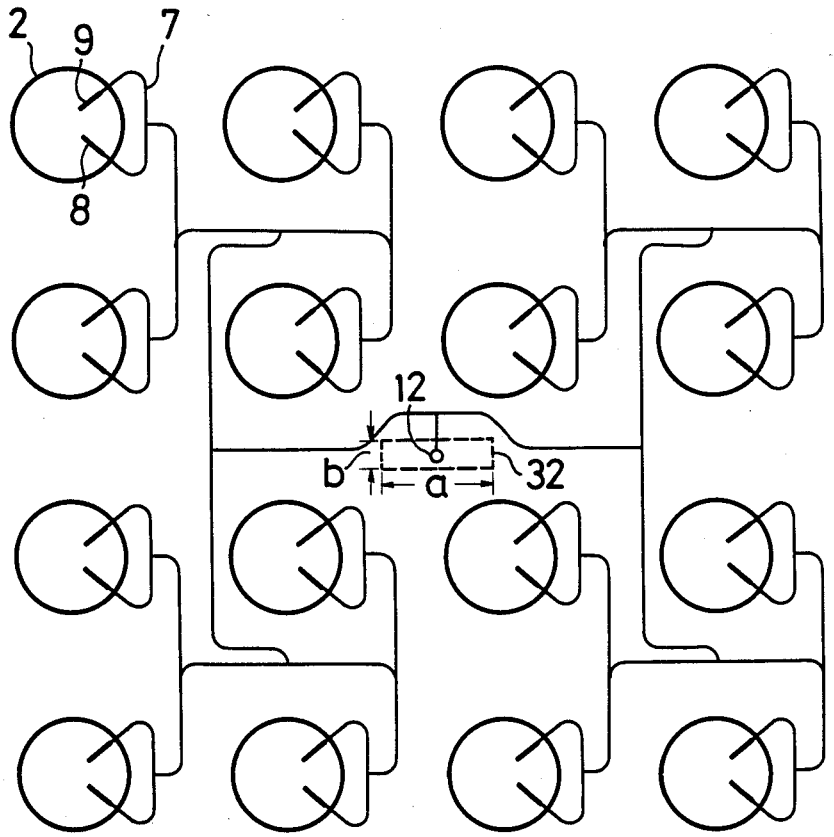

FIG. 14 shows an alternative feeding circuit, in which the wiring of the feed line of the central portion is partly changed so as to provide space for a rectanguar waveguide shown in outline by the dashed block 32, without removal of a radiation element. The width of the waveguide 32 is indicated in FIG. 14 as a, and its height is indicated as b. It is generally preferable that b=a/2. However, because of the spacing of the radiation elements, the height b must be shorter than the normal height. As a result, the characteristic impedance within the waveguide becomes lower, the length of the waveguide 32 must be kept short, and it is difficult to obtain matching over a wide band. It is also difficult to reduce the insertion loss of the arrangement illustrated in FIG. 14. All of these disadvantages are overcome by the design of FIG. 13.

By the foregoing, it will be appreciated that the present invention constitutes a simple and economical form of microwave antenna. It is apparent that various additions and modifications may be made in the apparatus of the present invention without departing from the essential features of novelty thereof, which are intended to be defined and secured by the appended claims.

What is claimed is:

1. A suspended line feed type planar antenna having a substrate sandwiched between a pair of conductive surfaces, each of said surfaces having a plurality of spaced openings defining radiation elements, a plurality of said openings having a pair of excitation probes formed perpendicularly to each other in a common plane, on said substrate, in alignment with said openings, and means for connecting signals received at said pair of excitation probes to a suspended line in phase with each other.

2. Apparatus according to claim 1, wherein said excitation probes are formed as printed circuit elements on said substrate.

3. Apparatus according to claim 1, including a suspended line interconnecting all of said excitation probes, said suspended line being formed as a printed circuit on said substrate and spaced between said two conductive surfaces.

4. Apparatus according to claim 1, wherein said means for connecting comprises first and second suspended line segments connected to said excitation probes and being perpendicular to each other, and means for interconnecting said first and second segments to said suspended line.

5. Apparatus according to claim 4, wherein said means for interconnecting comprises a common suspended line segment interconnecting said first and second suspended line segments, and a T connecting said common suspended line segment to said suspended line.

6. Apparatus according to claim 5, wherein said T is offset relative to the center of said common suspended line segment.

7. Apparatus according to claim 1, wherein said suspended line comprises a coaxial line having an inner conductor supported by said substrate and an outer conductor formed by said pair of conductive surfaces.

8. Apparatus according to claim 1, wherein said means for connecting comprises a pair of ¼ wavelength lines, each having one end connected to one of said excitation probes and the other end connected in common to a suspended line, and a resistor innerconnecting the said one ends of said ¼ wavelength lines.

9. Apparatus according to claim 8, wherein said resistor is formed as a printed circuit on said substrate.

10. Apparatus according to claim 8, wherein said resistor has a resistance of twice the characteristic of impedance of said suspended line.

11. Apparatus according to claim 1, comprising a rectangular array of said radiation elements, and said means for connecting comprises suspended line connecting means for connecting a plurality of said excitation probes to a centrally located feed point.

12. Apparatus according to claim 11, wherein said feed point is located at a position offset from the center of said array and occupies a position of one of said radiation elements closest to the center of said array.

13. Apparatus according to claim 11, including a resistor terminating a suspended line with the characteristic impedance of said line, said resistor being formed on said substrate as a printed circuit and located adjacent said feed point.

14. Apparatus according to claim 11, including a rectangular waveguide connected to said suspended line at said feed point.

15. Apparatus according to claim 14, wherein said rectangular waveguide has a width to height ratio of 2:1.

16. Apparatus according to claim 1, wherein said conductive surfaces comprise first and second conductive surfaces, said spaced openings in said first surface comprising completely open circular areas aligned with said radiation elements.

17. Apparatus according to claim 1, wherein said connecting means comprises a suspended line having a central conductor supported on one side of said substrate, and an outer conductor defined by elongate cavities in said pair of conductive surfaces on opposite sides of said line, said cavities each having a width less than the spacing between adjacent ones of said radiation elements.

18. Appartus according to claim 1, wherein said pair of excitation probes comprise first and second excitation probes, said first probe being supported on one side of said substrate and said second probe being supported on the same side of said substrate as said first probe.

19. A suspended line feed type planar antenna having a substrte sandwiched between a pair of conductive surfaces, each of said surfaces having a plurality of spaced openings defining radiation elements, a plurality of said openings having a pair of excitation probes formed perpendicularly to each other in a common plane, on said substrate, in alignment with openings, means for connecting signals received at said pair of excitation probes to a suspended line in phase with each other, and a plurality of conductive segments aligned and spaced from said excitation probes in alignment with said openings.

20. Apparatus according to claim 19, wherein said conductive segments are elongate, and are electrically connected to said conductive surfaces.

21. Apparatus according to claim 19, wherein said conductive segments are spaced end to end from said excitation probes.

22. Apparatus according to claim 19, wherein said conductive segments are formed as printed circuits on said substrate.

23. A suspended line feed type planar antenna comprising a substrate sandwiched between a pair of conductive surfaces, one of said surfaces having a rectangular array of spaced openings defining radiation elements, a corresponding rectangular array of radiators formed on said substrate in alignment with said openings, top and bottom plates on which said conductive surfaces are deposited, and feed means connected to said radiators, said feed means comprising a conductor adapted to be connected externally of said antenna, said feed means be centrally located in said rectangular array of radiators.

24. An antenna according to claim 23, wherein said feed means is located at a position offset from the center of said array, one of said radiation elements closest to the center of said array being omitted therefrom and said feed means being placed at that position.

* * * * *